US005268542A

United States Patent [19]

Voll

[11] Patent Number: 5,268,542

[45] Date of Patent: Dec. 7, 1993

[54] PUSH BUTTON OPERATED MULTI-STEP SWITCH INCLUDING FLEXIBLE CIRCUIT BOARD AND EXTENDING PUSH ELEMENT

[75] Inventor: Walter Voll, Hassfurt, Fed. Rep. of Germany

[73] Assignee: Mannesmann Aktiengesellschaft, Dusseldorf, Fed. Rep. of Germany

[21] Appl. No.: 891,838

[22] Filed: Jun. 1, 1992

[30] Foreign Application Priority Data

Jun. 5, 1991 [DE] Fed. Rep. of Germany ..... 4118743

[51] Int. Cl.[5] ..... H01H 13/70

[52] U.S. Cl. ..... 200/5 A; 200/1 B; 200/517; 200/520

[58] Field of Search ..... 200/5 R, 5 A, 512-517, 200/520-535, 1 B

[56] References Cited

U.S. PATENT DOCUMENTS 3,969,595 7/1976 Johnson ..... 200/5 A
4,527,030 7/1985 Oelsch ..... 200/5 A X
4,659,881 4/1987 Dowe ..... 200/5 R
4,771,139 9/1988 DeSmet ..... 200/5 A
5,118,912 6/1992 Itabashi ..... 200/534

*Primary Examiner*—J. R. Scott
*Attorney, Agent, or Firm*—Cohen, Pontani, Lieberman, Pavane

[57] ABSTRACT

A multi-step switch includes a resilient or resiliently mounted push button. In a first stage of the pressed-in state, the push button presses a contact surface against an at least partially resiliently constructed printed circuit board, which, on the upper side thereof, is provided with conductors. In a second stage of the pressed-in state of the switch, the push button and, in turn, the printed circuit board press with the aid of a resilient push element against additional conductors arranged underneath the printed circuit board. The multi-step switch is suitable for low switching capacities, particularly for use in hand-held control transmitters of remote controls.

11 Claims, 2 Drawing Sheets

PUSH BUTTON OPERATED MULTI-STEP SWITCH INCLUDING FLEXIBLE CIRCUIT BOARD AND EXTENDING PUSH ELEMENT

BACKGROUND OF THE INVENTION

1. Field of the Invention

The present invention relates to a multi-step switch having a resilient or resiliently mounted push button.

2. Description of the Related Art

A multi-step switch of the type mentioned above is known from DE AS 28 15 493 and has connecting terminals for lines for a multi-step control of operating currents of electric motors, for instance, in hoists and cranes or trolleys.

In modern plants, motors are frequently remote-controlled, for instance, by means of manual control transmitters employing infrared transmission of control signals. The known multi-step switches are not suitable for use in manual control transmitters in view of their size and high switching capacities. Change to commercial single step switches for low switching capacities is difficult since operators of the plants have become accustomed to multi-step switches.

SUMMARY OF THE INVENTION

Therefore, it is the object of the present invention to provide a multi-step switch of low switching capacity, particularly for use in manual control transmitters of remote controls.

This object is met, in accordance with the invention, by providing a multi-step switch in which, in a first stage of the pressed-in state, the push button presses a contact surface against an at least partially resiliently constructed printed circuit board which, on the upper side thereof, is provided with contacts or conductor tracks. In a second stage of the pressed-in state of the switch, the push button and, in turn, the printed circuit board press with the aid of a resilient push element against additional conductor tracks arranged underneath the printed circuit board.

Thus, two elements arranged one behind the other are provided for switching, wherein the first contact for the first step of a motor is closed upon slight pressure, while, upon stronger pressure, the second contact for the second step is also closed, wherein adjacent conductor tracks of the circuit boards are connected to each other. With such a multi-step switch, currents of 20–50 mA at a voltage of 2–5 volts can be switched. Such multi-step switches are small elements and can be arranged individually and in different number in a common housing for the most varied purposes of use.

In accordance with another feature of the invention, the additional conductor tracks can be arranged on another circuit board. The push button is preferably of elastic material and forms a protruding membrane within which a solid pressure ring is inserted. In the latter, in turn, there is inserted a contact ring of elastic material. Conductive material, for instance, graphite, is embedded in the contact ring. A built-in holding element on the housing or on a holding plate for several elements supports the contact ring.

In accordance with another feature of the invention, the element is part of the circuit board having punchouts which form a circular arc of about 330°, wherein arms formed by the punchouts are located opposite each other, resulting in a circular ring and a circular surface area within which the conductor tracks are interlocked with each other and bridged by the contact ring. On the side of the circular surface area opposite the contact ring, a push member is arranged for the further push element which, when depressed, bridges over the conductive tracks of the other circuit board. The push element is preferably rectangular or four-cornered with inwardly arched sides (diamond-shaped), wherein the corners of the push element form terminal points of one conductor track while another conductor track is connected in a center contact point.

Such a multi-step switch can be arranged with its circuit boards and the push button in a separate housing and be assembled as desired by the customer. However, if a larger number of switches all having the same number of push buttons is manufactured it is advisable to fasten the push buttons on a common holding plate and to produce on each circuit board a corresponding conductor track in resilient elements adapted to be bridged over by the contact surfaces. The circuit boards are then supported against each other by means of spacing bars or are fastened to the holding plate.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which are there are illustrated and described preferred embodiments of the invention.

DESCRIPTION OF THE PREFERRED EMBODIMENTS

Figure 1:
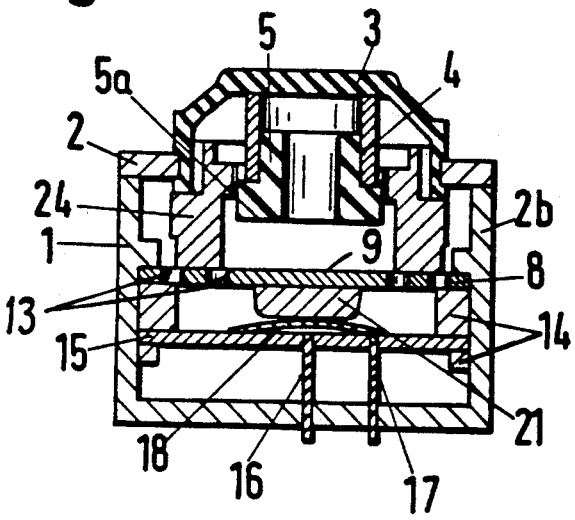
FIG. 1 is a sectional view of a housing with push button and two circuit boards.

FIG. 1 shows a housing 1 having an upper holding plate 2 for a push button 3 in the form of a curved membrane which is made of elastic material and is inserted in a bore in the holding plate 2. The push button 3 supports a stable push ring 4 having an inserted contact ring 5 of elastic material, for instance, rubber, on the contact surface 5*a* of which graphite is incorporated. The push button is supported by a holding element 24 on the holding plate 2 of the housing 1.

Figure 2:
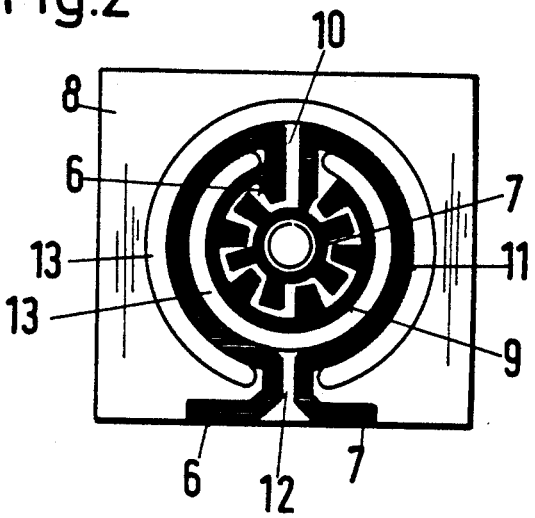
FIG. 2 is a top view of the conductor track 8 of FIG. 1.

When the push button 3 is depressed, the contact surface 5*a* presses against the central region of the printed circuit board 8. The conductor tracks 6 and 7 present in the circuit board 8 can be seen in FIG. 2.

The conductor tracks 6 and 7 are arranged in the contact region on a circular surface area 9 which is connected via an arm 10 with a circular ring 11. The latter is connected to the circuit board 8 via a holding arm 12 which is located opposite the arm 10. The conductor tracks 6 and 7 of the circuit board form the circuit. The conductor track 6 leads to an outer ring of the circular surface area 9 and has inwardly directed teeth, while the conductor track 7 extends to an inner ring of the circular surface area 9 and has outwardly directed teeth. When the contact surface 5a rests on the circular surface area 9, it forms the connection between the teeth of the conductor tracks 6 and 7. The conductor tracks 6 and 7 lead from the holding arm 12 via the circular ring 11 to the arm 10, wherein free spaces 13 are present on both sides of the circular ring 11, so that the spaces permit yielding of the circular surface area 9 with respect to the circuit board 8 upon the pressing of the push button 3.

Figure 3:
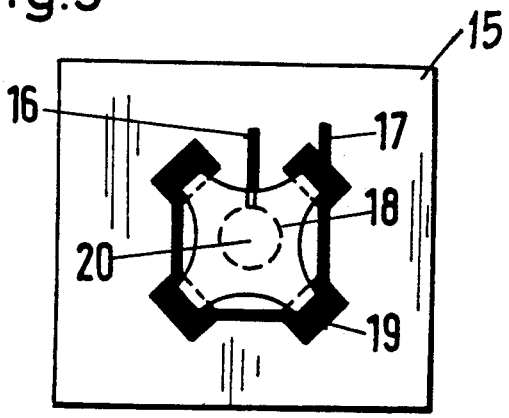
FIG. 3 is a top view of the conductor track 15 of FIG. 1.

A push member 21 arranged below the circular area 9 lies in its position of rest without pressure on a curved push element 18 which is fastened on the lower circuit board 15. FIG. 3 shows that the push element 18 is four-cornered with inwardly arched sides forming the shape of a diamond and its corners rest on connecting points 19 all of which are connected to a conductor track 17. The circuit board 15 has a central contact point 20 located between the connecting points 19 and connected with a conductor track 16, wherein the contact point 20 is connected by the push element 18 to the connecting points 19 of the conductor track 17 when the push element 18 is depressed. Between the circuit boards 8 and 15 there are spacer elements 14 which hold the circuit boards 8 and 15 on side walls 2b.

Figure 4:
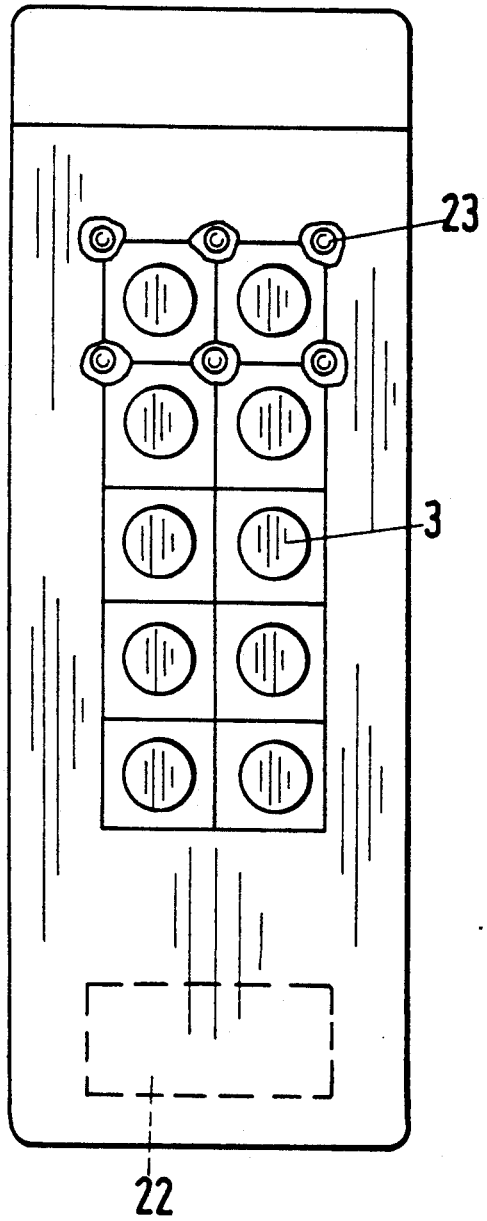
FIG. 4 is a front view of a switch assembly including a housing having several push buttons and switch elements.
Figure 5:
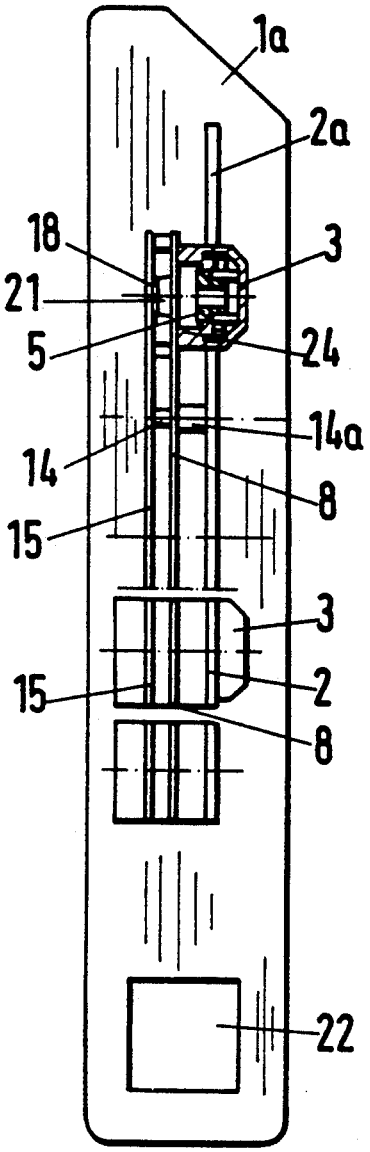
FIG. 5 is a side view showing the essential elements of the switch assembly of FIG. 4.

FIGS. 4 and 5 show a housing 1a for ten multi-step switches. The push buttons 3 of the switches can be seen in FIG. 4. FIG. 5 shows in its upper part how the push buttons 3 are fastened in a common holding plate 2a of the housing 1a by holding elements 24. The contact rings 5 are directed towards the common circuit board 8. Push elements 21 extend from circuit board 8 up to the push elements 18 of the circuit board 15. FIG. 5 further shows spacer elements 14 and 14a for holding the circuit boards 8 and 15 against each other and against the holding plate 2a. Screws 23 required for the spacer elements are indicated in FIG. 4. A battery 22 arranged within the housing 1a supplies the circuit with power.

In the lower part of FIG. 5, it is indicated how individual elements in accordance with FIG. 1 can be inserted in the same housing 1a. The switch assembly having 10 multi-step switches for the different motors which is shown in FIGS. 4 and 5 is suitable for controlling a crane.

It should be understood that the preferred embodiments and examples described are for illustrative purposes only and are not to be construed as limiting the scope of the present invention which is properly delineated only in the appended claims.

I claim:

1. A multi-step switch comprising a housing and a resilient or resiliently mounted push button mounted in the housing, the push button having a contact surface, the push button being movable between a position of rest and a first pressed-in-position and between the first pressed-in position and a second pressed-in position further remote from the position of rest, the switch further comprising an at least partially resilient circuit board mounted in the housing spaced from the contact surface when the push button is in the position of rest, the circuit board having an upper side with conductors and a bottom side, wherein the contact surface presses against the circuit board when the push button is in the first pressed-in position, and a resilient push element of conductive material arranged on the bottom side of the circuit board, further comprising an additional circuit board mounted in the housing, additional conductors being mounted on the additional circuit board, the additional conductors being mounted spaced from the circuit board, such that the push element is pressed by the circuit board against and bridges the additional conductors when the push button is in the second pressed-in position.

2. The multi-step switch according to claim 1, wherein the push button comprises an outwardly projecting membrane of elastic material, a solid pressure ring being mounted in the membrane, and a contact ring being mounted in the pressure ring.

3. The multi-step switch according to claim 2, wherein the contact ring is of elastic material, the contact surface being provided on the contact ring, and wherein conductive material is embedded in the contact surface.

4. The multi-step switch according to claim 3, wherein the conductive material is graphite.

5. The multi-step switch according to claim 2, comprising a holding plate mounted on the housing, and a holding element having first and second sides, the first side of the holding element resting against the holding plate, and the second side of the holding element connecting the push button to the housing.

6. The multi-step switch according to claim 5, wherein the holding plate is a cover of the housing, the housing having side walls, the push button being fastened to the cover plate, and the circuit board and the additional circuit board being fastened to the side walls of the housing.

7. The multi-step switch according to claim 2, wherein the circuit board comprises a resilient portion, the resilient portion being a circular ring connected to the circuit board by means of a support arm, the circular ring being supported on a side opposite the support arm by means of another arm, wherein free spaces define a circular arc of approximately 330° existing between the circular surface area and the circular ring and between the circular ring and the circuit board, the circular ring having two halves, the conductors extending from the circuit board through the holding arm, the two halves of the circular ring, and through another arm into the circular surface area, wherein one of the conductors forms an outer ring with inwardly directed teeth and another of the conductors forms an inner ring with outwardly directed teeth, the outwardly directed teeth being located between the inwardly directed teeth, such that the contact ring bridges the inwardly directed teeth and the outwardly directed teeth when the push button is in the first pressed-in position.

8. The multi-step switch according to claim 7, comprising a push member mounted on the bottom side of the circuit board underneath the circular surface area and facing the push element.

9. The multi-step switch according to claim 8, wherein the push element is rectangular and has corners, the corners being connecting points of one of the additional conductors, entering a central contact point which is connected to another of the additional conductors.

10. The multi-step switch according to claim 8, wherein the push element is four-cornered with inwardly arched sides, the corners of the push element forming connecting points of one of the additional conductors, and wherein a central contact point is connected to the other of the additional conductors.

11. The multi-step switch according to claim 1, comprising spacer elements, the circuit board and the additional circuit board resting against the spacer elements, wherein the push button is fastened on a holding plate which is adapted to receive a plurality of push buttons of multi-step switches.

* * * * *